United States Patent [19]

Gelb et al.

[11] Patent Number: 4,992,310

[45] Date of Patent: Feb. 12, 1991

[54] FIRE POUCH

[75] Inventors: Gabriel M. Gelb, 11709 Durrette, Houston, Tex. 77024; William A. Mallow, San Antonio, Tex.; Scott Stropkay, Boston, Mass.

[73] Assignee: G. M. Gelb, Houston, Tex.

[21] Appl. No.: 371,609

[22] Filed: Jun. 26, 1989

[51] Int. Cl.[5] ..... A62C 3/00; B65D 85/00

[52] U.S. Cl. ..... 428/345; 109/80; 229/68 R; 428/35.2; 428/920; 169/50

[58] Field of Search ..... 383/110; 229/68 R; 150/901; 104/80; 169/50; 428/34.5, 35.2, 920, 921

[56] References Cited

U.S. PATENT DOCUMENTS

| | | | |
|---|---|---|---|
| 3,782,475 | 1/1974 | Schmidt | 169/50 |
| 4,424,867 | 1/1984 | Mallow | 169/43 |
| 4,597,450 | 7/1986 | Budmiger | 169/50 |
| 4,624,320 | 11/1986 | Romaine | 169/50 |
| 4,756,945 | 7/1988 | Gibb | 428/920 |
| 4,844,960 | 7/1989 | Spriggs et al. | 428/920 |

*Primary Examiner*—James Seidleck

*Attorney, Agent, or Firm*—Browning, Bushman, Anderson & Brookhart

[57] ABSTRACT

A fire pouch is provided for protecting flammable documents from both fire and water damage. The fire pouch includes a thin pliable water-type exterior container which houses a gelled water material to absorb thermal energy during the fire. The fire pouch further comprises a hydrated intumescent material layer which is secured to the exterior container, and both absorbs thermal energy and intumesce during a fire to produce a foam layer which provides substantially increased fire protection. The gelled water layer and the hydrated intumescent material layer form a relatively thin pliable rectangular-shaped blanket having a seam which divides the blanket into a base portion and a cover portion. The blanket unfolds by bending substantially along the seams to receive the flammable documents, and folds into its protective position such that the documents are sandwiched between the based portion and the covered portion to protect the docments during a fire.

20 Claims, 2 Drawing Sheets

FIRE POUCH

BACKGROUND OF THE INVENTION

1. Field of the Invention

The present invention relates to devices for protecting combustible valuables from fire and/or water damage and, more particularly, relates to a relatively low cost yet attractive consumer product suitable for protecting documents, photographs and other materials from damage otherwise caused by residential or commercial fires.

2. Description of the Background

A variety of containers have been devised for protecting combustibles from fire and/or water damage. Use of such containers by consumers has long been limited, however, due to the combination of comparatively high cost for reliable devices, relatively low protection afforded by low cost devices, and the general unattractiveness, weight, and bulkiness and of such devices. Accordingly, legal documents, memorabilia, photographs, etc. are commonly lost in house and/or apartment or office fires, and such documents either cannot be replaced or, can only be replaced only at a significant cost.

Prior art fire protective devices include a molded plastic case weighing approximately 20 pounds and having a ceramic cement core over 1" thick. This device has understandably found little acceptance by consumers, although the product reportedly has a ½-hour rating at 1550° F. external temperature, with a maximum 350° F. inside temperature. In order to protect photographs and other "special media" valuables, a product in excessive of 40 lbs. and costing in excessive of $200 is available, although even that product may be inadequate to prevent damage to its interior valuables.

Due to the long felt need for an attractive, reliable and relatively low cost consumer product for protecting combustibles, a large amount of diverse technology has heretofore been applied for solving this need. U.S. Pat. Nos. 3,082,713, 4,637,000 and 3,292,748 teach fire resistant pouches, with optional zippers to more reliably seal the region of the bag opening. U.S. Pat. Nos. 3,428,104 and 3,066,847 teach multi-layer envelopes for providing protection to interior documents. U.S. Pat. Nos. 2,022,251 and 2,520,972, as well as U.K. Patent No. 2,102,765, each teaches the utilization of alternate ideas for protecting combustibles from fire.

Apart from technology specifically directed to protect documents, photographs, and similar readily-combustible products, other patents are generally directed to fire protective materials. U.S. Pat. No. 4,624,320 teaches a fire blanket which may be used to form various pieces of protective clothing. The blanket disclosed in this patent comprises of polyester material which acts as a carrier for a hydrous gel. To prevent the material from becoming stuck together, a thin PVC layer is provided on one side of the blanket. U.S. Pat. No. 4,612,239 similarly discloses a multi-layer fire protection product which undergoes an endothermic reaction to release a non-flammable gas and simultaneously absorb heat in the presence of a fire. In an embodiment, the fire protective material comprises a fiberglass layer, an intermediate layer which will decompose to release a non-toxic and non-flammable gas, a fiberglass insulation layer, and a protective cover. U.S. Pat. No. 4,600,634 discloses a fire-protective sheet material which includes an inorganic fiber, an organic polymer binder, and an inorganic filler. The ratio of organic binder to the inorganic material enhances the endothermic reaction and cooling vapor retention aspects of the inorganic material, since water vapor is given off when the article is heated. Finally, U.S. Pat. Nos. 4,600,606 and 4,405,076 are directed to other embodiments of fire-resistant material.

In spite of there being an abundance of patents directed to fire protective materials generally, and a similar abundance of patents particularly directed to devices for protecting papers, photographs, and other readily-combustible items from fire, a low-cost yet attractive fire protective device is not currently available which satisfies the consumer's needs. Currently available devices generally do not provide reasonable protection to combustibles at a relatively low-cost, and are typically both unreliable and unattractive. The disadvantages of a prior art are, however, overcome by the present invention, and an improved fire pouch is hereinafter disclosed which may be reliably utilized by consumers and/or small businesses to protect valuable papers and photographs from fires.

SUMMARY OF INVENTION

The present invention discloses a particular type of enclosure, container, shell, or similar device which protects readily combustible products therein from fire and/or water damage, and will be hereinafter generally referred to as a fire pouch. The configuration of the fire pouch according to the present invention is markedly different when in its opened or unprotective position than when in its closed or protective condition, and in the former case may comprise a substantially planar blanket with an uppermost mylar sealing bag. The cover and flaps of the pouch are pliably connected to the planar base of the pouch, and in the closed condition the rectangular-shaped cover and similarly-shaped base sandwich the documents therebetween, while triangular-shaped flaps lie on top of the cover to fully protect the interior combustibles.

In cross section, the pouch material for the base and cover may comprise an exterior fluid-tight and comparative thin bag containing gelled water, and an interior thin layer of granular silicate hydrates. The water may be housed in a reticulated urethene foam liner, and absorbs the intitial thermal energy of a fire. In the event of a sustained fire, the silicate hydrates absorb additional thermal energy and expand by a foaming action to produce a relatively thick (e.g., one to two inches) foam layer which offers the desired fire and heat protection. The granular silicate gel may be normally retained in place by a quilted glass cloth bag. An interior mylar bag functions as a moisture or water barrier, and various types of decorative interior liners or exterior coverings may be provided to meet the demands of market appeal. The particular composition of the protective materials for the fire pouch according to the present invention thus absorbs thermal energy during a fire by vaporizing materials and forming a thermally insulative protective foam. This combination of materials allows combustibles within the pouch to withstand in excess of a 1600° F. fire for thirty minutes or more. The rectangular-shaped cover and the triangular-shaped flaps may be maintained in place opposite the combustible materials from the base by a conventional mechanical fastener designed to withstand high temperatures.

In one embodiment, the fire pouch comprises a rectangular-shaped base and a similarly-shaped cover pliably connected to the base. Both the base and cover may include similar sheet-like layers of exterior gelled water and interior granular silicate hydrates, as noted above. The gelled water layer need not be provided for the triangular side flaps, as well as from the triangular front flap, thereby further reducing manufacturing costs, since the top of the interior documents are protected by the cover. To still further reduce manufacturing costs, a hinge zone between the adjoining edges of the cover and base employs a plurality of intermittent seams, such that the gelled water communication across the intermittent seam and between the cover and base is permissible. Continuous sealed seams along the remaining edges of both the cover and base maintain the gelled water within its rectangular-shaped enclosure, (since gelled water need not be provided for the triangular-shaped flaps.)

It is an object of a present invention to provide an improved, relatively low cost device for protecting combustible products from fire and/or water damage.

It is a further object of the invention to provide a reliable enclosure for protecting readily combustible products wherein the enclosure comprises a base and a cover pliably connected to the base, and with the base and the cover each including a similar exterior layer of a gelled water and an interior layer of a hydrated material.

It is another object of this invention to provide an attractive fire pouch for protecting valuables, such as papers and photographs, from fire damage, wherein the fire pouch has a substantially blanket-like configuration when in its opened or unprotected position, and has a substantially parallelepiped configuration when in its closed or protected condition.

It is a feature of the present invention that the fire pouch is relatively lightweight, yet provides reliable and comparatively long-term fire protection at high temperatures.

As a further feature of the present invention, the gelled water layer in both the base and the cover of the fire pouch are in fluid communication, such that both the cover and base can be filled from a single input port to further reduce manufacturing costs.

Yet another feature of the present invention is that a sealable bag be securely attached to interior of the base and/or cover, such that documents can be placed within the bag and will be protected from water damage in the event of a fire.

It is an advantage of the present invention that the fire pouch may be easily and economically fabricated in various sizes to meet varying consumer requirements.

It is a further advantage of the invention that the materials which provide fire protection for the fire pouch may be readily covered with an exterior decorative covering or an interior lining to provide various attractive exterior and interior designs for the fire pouch user.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
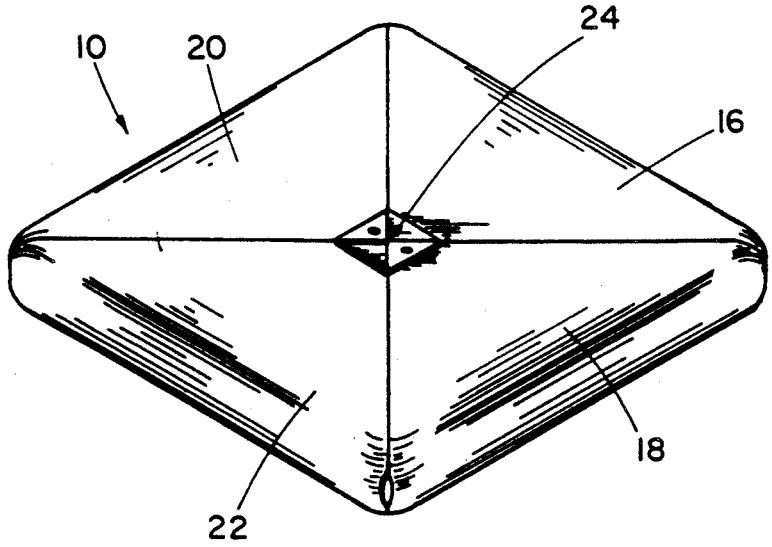
FIG. 1 is a pictorial view of a fire pouch according to the present invention in its closed or protective position.

FIG. 1 depicts a fire pouch 10 according to the present invention, which in its normal or protective condition has a generally parallelepiped configuration. The particular fire pouch shown in FIG. 1 is well suited for covering and protecting from fire damage a conventional photo album, although it should be understood that the fire pouch may be used for protecting various documents from fire damage, such as papers, photographs, film, computer diskettes, and similar highly combustible materials.

Figure 2:
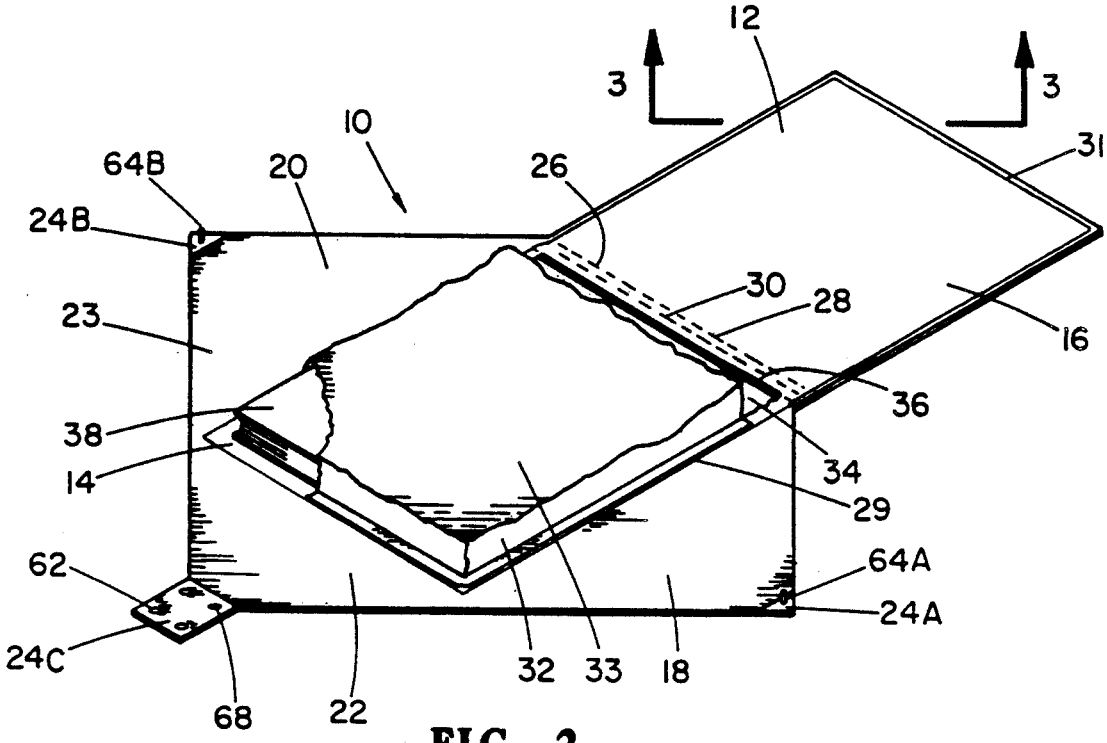
FIG. 2 is a pictorial view of a fire pouch according to the present invention in its fully opened or unprotective position.

As shown more clearly in FIG. 2, the fire pouch 10 comprises a blanket-like first material layer 12 including a base portion 14 and a cover portion 16. The pouch includes side flap portions 18 and 20, as well as front flap portion 22, each of which is formed from another blanket-like second material layer 23.

The blanket-like first material layer 12 preferably has a rectangular configuration, while each of the flaps 18, 20, and 22 perferably has a triangular configuration and are secured at one edge to the adjoining edge of the first material layer 12. Clasp 24 functions as a selectively engagable means for interconnecting apex ends of each of the triangular-shaped flaps to maintain the flaps in their secured position, as shown in FIG. 1. Interconnecting means 24 may take on various forms and embodiments, one example of which is discussed further below.

FIG. 2 depicts the fire pouch 10 according to the present invention in its opened or unprotective position, e.g., in the position for either reviewing documents ordinarily stored in the fire pouch 10 its protective position, or waiting to receive a document that is subsequently folded over as explained below to achieve its protective position as shown in FIG. 1.

As shown in FIG. 1, the blanket-like first material layer 12 includes a preferably rectangular-shaped base portion 14 in a similarly-shaped covered portion 16, each of which preferably may be substantially square-shaped. A seam 26 divides the blanket-like first material layer 12 into the base portion 14 and the cover portion 16. Seam 26 comprises a non-continuous elongate seam 28 and a similar seam 30 parallel therewith and spaced slightly from seam 28, and each of seams 28 and 30 may be easily formed from with thread-like stitching material 31. The same thread-like stitching material may be used to form in a continuous seam 29 about the perimeter of the blanket-like first material layer 12, as noted below.

Secured to either the base portion 14 or the cover portion 16 is a water-tight document container 32 which includes a "bag-shaped" portion 33 and a cover portion 34 having a sealing strip 36 for substantially sealing the portions 33 and 34 together. As shown in FIG. 2, the document container 32 may resemble a substantially-enlarged "sandwich" container, and seam 36 may be sealed to the "bag" portion 33 by any suitable mechanism, such as the technique commonly employed to seal sandwich bags. The material for the fluid-tight document container 32 preferably may be aluminized nylon, which has sufficient rigidity to maintain "loose" document within the bag which holds a desired structure, and is sufficiently thick and tough such that repeated insertion and removal of a conventional photo album 38 does not damage or ruin the bag. The water-tight document container provides nominal protection to the documents interior thereof from fire damage, but does provide substantial protection for those documents from water damage, which may be caused from various sources familiar to those in the insurance industry, including but limited to water damage from a fire.

The high degree of protection provided to the interior documents from an exterior fire is provided by the blanket-like first material layer 12. The material layer 12 is substantially uniform throughout, and is relatively thin. Typical dimensions for a suitable first material layer may be from 8" to 20" wide, and from 16" to 40" long, such that the seam 26 divides the first material layer into equally-sized first and second portions. The dimensions for the triangular-shaped flaps which form the second material layer will of course be determined by the size of the first material layer if the flaps are formed from similarly-shaped triangular portions as disclosed herein.

Figure 3:
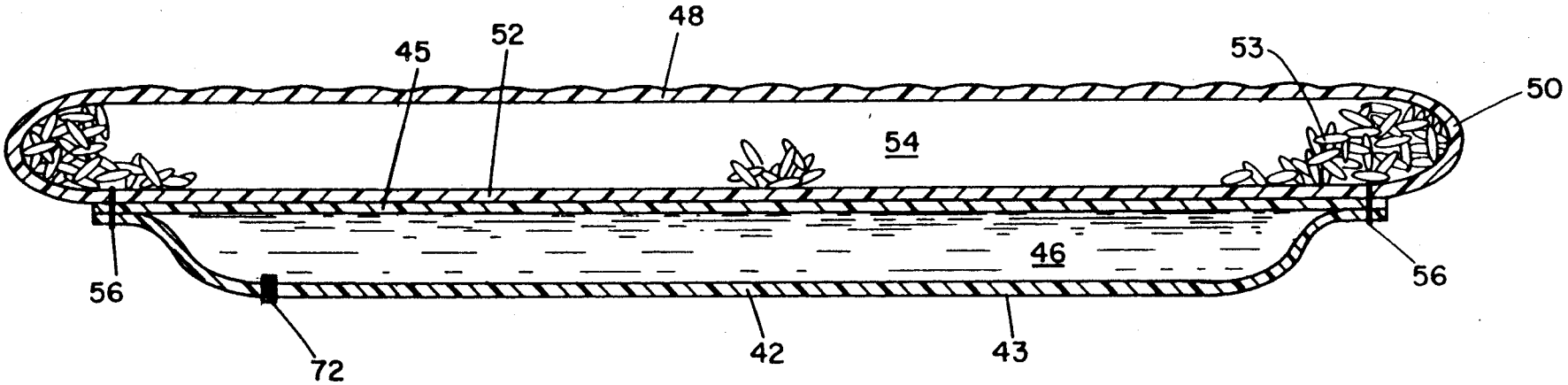
FIG. 3 is a detailed cross-sectional view of the cover taken along line 3—3 in FIG. 2.

As shown in cross-sectional FIG. 3, the first material layer comprises a thin pliable fluid-tight exterior container 42 having an interior defined by an outer skin layer 43 in an inner skin layer 45 spaced from and preferably substantially parallel to the outer skin layer 43. Substantially the entirety of the interior of the container 42 is filled with a gelled water material 46 which absorbs thermal energy during a fire. Various materials may be used to form the gelled water material layer, although a preferential gelled water material is formed from water and sodium silicate. Also, while various materials may be used for forming the exterior container 42, a preferential material for such an exterior container is reticulated urethane.

The first material layer 12 also comprises a hydrated material layer 54 which preferably is also an intumescent material layer. Such a suitable material is available in granular form, so that the functional aspect layer 54 may be accomplished with a multitude of small granular pellets 53. Again, while various materials may be used to form the intumescent material layer, a suitable material for this layer is a granular hydrated gel material which is selected from a group consisting of the hydrates of silica, sodium borate, and sodium. The granular pellets 53 are "contained" by a quilted material 50, which itself has an interior layer 48 and an exterior layer 52. A suitable material for the quilted layer 50 for containing the functional granular pellets 53 abound, and include mineral cloth, glass cloth, and mineral wool, ceramic cloth and metal foil, each of which has a readily ascertainable fire rating. As previously noted, however, substantially the entire fire-protecting function of the blanket-like first material layer 12 is accomplished by the combination of the gelled water layer 46 and the hydrated intumescent material layer 54.

The fluid-tight exterior container 42 and the gelled water material 46 therein of the blanket-like first material layer 12 comprise a relatively thin pliable blanket. A suitable first material layer 12 when folded into its unprotective position as shown in FIG. 2 may have typical dimensions of approximately 14" wide and 30" long, with the seam 26 dividing the blanket into a base portion and a similar-shaped cover portion. The thickness of the gelled water layer preferably is from $\frac{3}{8}$" to $\frac{3}{4}$", while the hydrated intumescent material layer 54 has a thickness approximately equal to that of the gelled water layer. Due to the granular composition of the hydrated intumescent material layer 54, layer 54 may also be a pliable material layer. Accordingly, the entire blanket-like first material layer 12 is a pliable material layer having a relatively thin cross-section of, e.g., approximately $\frac{3}{8}$ of an inch thick. As previously noted, the gelled water material layer is the exterior material layer which functions during the fire to absorb thermal energy and thereby to protect the interior document. The pliable hydrated intumescent material layer 54 is the interior material layer of the blanket when in its protective position, and functions to both absorb thermal energy in a manner similar to the gelled water material layer 46, and to intumesce during a fire to produce a foam layer substantially thicker than the normal thickness of the pliable hydrated intumescent material layer as shown in FIG. 3. Accordingly, it should be understood that a $\frac{1}{4}$" intumescent material layer 54 can intumesce during a fire to produce a protective foam layer having a thickness of from 1" to 2".

From the explanation provided above, it should now be understood that the thin pliable blanket formed by the gelled water material layer and the hydrated intumescent material layer can unfold to receive the flammable documents, and fold to substantially enclose and protect the flammable documents during a fire. The water-tight document container 32 may be fixed by an adhesive or other suitable means to the base portion of the first material layer, so that this container is positioned interior of the pliable blanket and houses the flammable documents to protect the documents from water damage.

FIG. 3 also depicts the continuous thread-like stitching 56 about the perimeter of the exterior container 42, with functions to both seal the outer skin layer to the inner skin layer such that gelled water 46 does not leak out of the exterior container, and secures the exterior container to the hydrated intumescent material layer. In other words, a conventional sewing process may be used to form a continuous, rectangular-shaped seal 56 which maintains the gelled water within the container 42 and which secures the gelled water layer 46 to the granular intumescent material layer 54 along the perimeter of each of these layers to form a substantially two-layer pliable blanket. The gelled water layer is thus the "lower" layer when the blanket is in the unfolded position as shown in FIG. 2, and is the exterior layer of both the base portion 14 and cover portion 16 of the blanket when in its folded or protective position. Similarly, the intumescent granular material layer 54 is the "upper" layer of the blanket when in its unfolded position, and is the interior layer of the blanket when in its folded or protective position. In cross section, therefore, the blanket-like first material layer 12 in combination with the photo album 38 consists of an upper gelled water layer formed by the cover portion, an upper granular hydrated intumescent material layer formed by the cover portion, the "top" layer of the laminated Mylar bag 32, the photo album, the "bottom" layer of the Mylar bag 32, the granular material layer 54 of the base portion 14, and finally the gelled water layer 46 of the base portion 14. Effective fire protection for the documents "sandwiched" between the base portion and the cover portion of the blanket-like first material layer 12 is provided by the combination of the gelled water layer and the granular material layer, as noted above, while the aluminized Mylar bag 32 functions to seal the photo album 38 within the bag 32 to protect the photo album from water damage.

Since the continuous seam 56 essentially defines the perimeter of the gelled water material layer 46, it can be seen from FIG. 2 that the granular material layer 54 of the blanket-like first material layer 12 may extend outward of 56 to form the triangular-shaped side flaps 18 and 20, as well as the triangular-shaped front flap 22. Each of these triangular-shaped flaps thus form the second pliable blanket-like material layer, which is secured to a perimeter of the first material layer 12 and extends outwardly therefrom when the pouch is in its opened or unsecured position as shown in FIG. 2. Each of the flaps 18, 20, and 22 are thus formed from the hydrated intumescent material layer which is contiguous with the hydrated intumescent material layer which forms the first material layer 12. The first material layer 12 and each of the triangular-shaped flaps lie substantially within a single plane when the fire pouch is "laid open" on a table in its unprotected position as shown in FIG. 2. The pliable nature of the blanket-like materials of both the first material layer and the triangular-shaped flaps allows the cover portion 16 to fold substantial along the intermittent seams 26, and further allows the triangular-shaped flaps to fold substantially along the respective portion of seam 31 so that the fire pouch can easily form a substantially parallelepiped configuration when in its closed or protective position, as shown in FIG. 1.

In a suitable embodiment, the interconnecting means 24 may comprise a substantially triangular-shaped metal plate 24A at the apex of the side flap 18, and a similarly-shaped plate 24B at the apex of the side flap 20, while a substantially rectangular-shaped plate 24C is provided at the apex of the front flap 22. Each of the plates 24A, 24B, and 24C may be secured to its respective flap by a crimping operation (which may be provided by a small press), so that each of the metal sheets is permanently secure to its respective flap. The rectangular-shaped metal plate 24C secured to the front flap 22 may have a plurality of through apertures 60 and 62 (see FIG. 2), while each of the triangular-shaped metal plates 24A and 24B have a pin 64A and 64B, respectively, for fitting within a respective aperture 60, 62. The securing means 24 thus serves to maintain the triangular-shaped flaps in their secured position as shown in FIG. 1, while allowing the trianglar-shaped flaps to unfold by lifting the pins 64 out of the respective apertures in the plate 24C so that the triangular-shaped flaps can be unfolded and the cover 16 then unfolded so that the fire pouch achieves its unprotective position as shown in FIG. 2.

It should be noted that the seam 26 which separates the base portion from the cover portion of the rectangular-shaped first material layer 12 is a non-continuous seam, such that gelled water communication past the seam 26 and between the base portion 14 and the cover portion 16 is possible whether the fire pouch is in its unfolded or unprotective position as shown in FIG. 2, or in its folded or protective position as shown in FIG. 1. In order to further reduce manufacturing costs, a single check valve 72 as shown in FIG. 3 may be provided in either the base portion or the cover portion to allow gelled water 46 to be easily inserted and sealed within the interior of the exterior container 42 from a single input point. In other words, the non-continuous seam 26 allows gelled water to be input into the cover portion 16 as shown in FIG. 2, while seam 26 allows the gelled water to go past the seam 26 into the base portion of the blanket-like first material layer 12 so that both the base portion and the cover portion can be easily filled with gelled water from a single input port. The seam 26, as well as the continuous seam 29 between the adjoining edge of the first material layer 12 and the flaps 18, 20 and 22 which form the second material layer, allow for easy bending of the first pouch material as discussed herein substantially along a respective seam.

Figure 5:
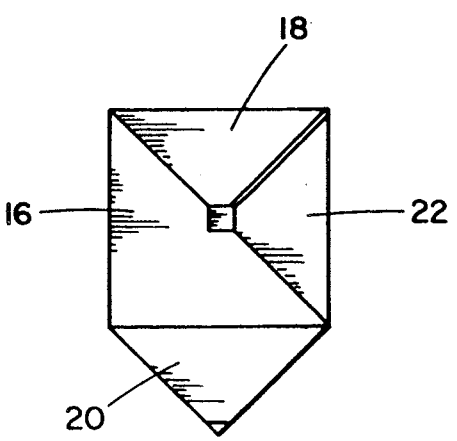
FIG. 5 is a simplified top view of a fire pouch according to the present invention with the cover, one side flap, and one front flap folded over the cover.
Figure 4:
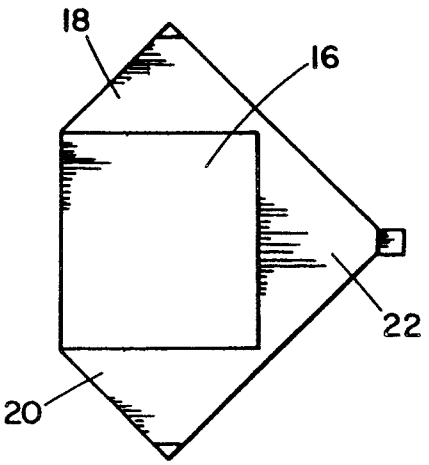
FIG. 4 is a simplified top view of a fire pouch according to the present invention with the cover folded over the base.

To use the fire pouch as described above, the cover portion 16 may be unfolded from the base portion 14, with the triangular-shaped flaps 18, 20, and 22 also unfolded to form a thin blanket which lies in a substantially single plane, as shown in FIG. 2. With the cover 34 of the Mylar bag 32 opened as shown in FIG. 2, a photo album or other document may be inserted into the bag 32, and the cover 34 positioned for forming a substantially water-tight seal between the cover and the bag along the seal strip 36. With the documents thus sealed within the bag 32, the cover may be folded substantially along the seam 26 so that the cover it is positioned "over" the Mylar bag and documents, and accordingly the base portion 14 and the cover portion 16 effectively "sandwich" the documents there-between. At this stage, the fire pouch will thus resemble the simplistic view shown in FIG. 4. Next, the front triangular-shaped flap 22 may be folded over the cover so that the metal plate 24C is now adjacent the middle of the cover portion 16. Either one of the side flaps 18 or 20 may next be folded over, and its respective projecting pin 64 inserted within a suitable aperture appature in the plate 24C, so that the side flap is interconnected to the front flap. At this state, the fire pouch will thus be in a position substantially shown in FIG. 5. Finally, the other side flap 18, 20 may be folded over and its respective projecting pin 64 inserted into the other aperture 60, 62, so that the apex of both side flaps and the front flap effectively "meet" in the vicinity of the middle of the cover 16 and become interconnected by 24 to hold these flaps together, thereby securing the fire pouch in its folded or protective position. The fire pouch in this position is shown in FIG. 1, and the documents are now safely secured in the interior thereof. The fire pouch may then be stored in any suitable location desired by the user. The process of unfolding the fire pouch to temporarily remove the documents therefrom will now be obvious from the foregoing description.

The fire pouch according the the present invention is able to obtain in extremely high fire rating due to the combination of the materials selected for the first material layer 12, and the overall design of the fire pouch. While the first material layer 12 provides most of the desired fire protection, it should be understood that the triangular-shaped flaps 18, 20 and 22 provide additional fire protection since each of these flaps is also formed from a hydrated intumescent material layer. As previously noted, the alumunized Mylar bag 32 provides little if any fire protection for the documents, but does provide a valuable protection by sealing the interior documents from water damage.

Tests has revealed that the fire pouch according to the present invention is able to reliably withstand in excess of a 1,600° F. fire exterior on the fire pouch for a time of 30 minutes or more. As those skilled in the art will appreciate, this is an extremely high rating for a low cost fire protective device, particularly one which has a weight in a range of from only 12 to 15 pounds and can be sold to residential and small business consumers. Even under the above-described conditions, documents within the sealed Mylar bag within the fire pouch as shown in FIG. 1 do not obtain a temperature in excess of 212° F., so that combustion of these interior documents does not occur.

As previously noted, the fire pouch as according to the present invention can be easily and economically fabricated in various sizes to meet consumer demands. Also, the fire pouch according to the present invention may be provided with various decorative coverings exterior of the gelled water outer layer, and also exterior of the granular intumescent layer which forms the triangular-shaped flaps, thereby providing an attractive exterior design to the customer. Similarly, any desired interior lining may be provided in contact with the interior quilted layer 48 of the granular hydrated intumescent material layer for both the blanket-like first material layer 12, as well as the interior of the triangular-shaped flaps, to provide an attractive interior lining for the fire pouch.

Various other changes and modifications will now be apparent from the foregoing description to those skilled in the art. The Mylar bag 32 may, for example, be permanently heat sealed to secure the bag to the base portion or the cover portion of the first interior layer 12. Also, various interconnecting means may be used for securing the side flaps and front flap together as shown in FIG. 1, and thus maintain the first material layer in its folded or protected position. Other suitable interconnecting means can thus be utilized which are quite different from the interconnecting means discussed herein.

These and other further modifications, features, and advantages of the present invention must now be apparent from the foregoing description. These further modifications and advantages are, however, contemplated by and within the scope of the present invention, which is defined by the claims which follow.

What is claimed is:

1. A fire pouch for protecting flammable documents from fire and/or water damage, comprising:

a thin pliable fluid-tight exterior container having an interior defined by an outer skin layer and an inner skin layer spaced from the outer skin layer;

a gelled water material substantially filling the interior of the exterior container for absorbing thermal energy during a fire;

a pliable hydrated intumescent material layer in contact with the inner skin layer opposite the gelled water layer to absorb thermal energy and intumesce during a fire to produce a foam layer substantially thicker than the pliable hydrated intumescent material layer;

the exterior container and the hydrated intumescent material layer forming a relatively thin pliable blanket which unfolds to receive the flammable documents and folds to substantially enclose and protect the flammable documents during a fire; and a water-tight document container positioned interior of the folded blanket for housing the flammable documents to protect the documents from water damage.

2. The fire pouch as defined in claim 1, further comprising:

the hydrated intumescent material layer is formed from a granular hydrated gel; and a quilted bag for housing the granular hydrated gel, the quilted bag being formed from relatively noncombustible material selected from a group consisting of glass cloth, mineral cloth, mineral wool, ceramic cloth, and metal foil.

3. The fire pouch as defined in claim 2, wherein the material for the granular hydrated gel is selected from a group consisting of hydrates of silica, sodium borate, and sodium.

4. The fire pouch as defined in claim 1, wherein the perimeter of the fluid-tight exterior container is sealed with the hydrated intumescent material layer to seal the gelled water material within the exterior container.

5. The fire pouch as defined in claim 4, further comprising:

thread-like stitching about the perimeter of the exterior container for simultaneously sealing the outer skin layer to the inner skin layer and sewing the exterior container to the hydrated intumescent material layer.

6. The fire pouch as defined in claim 4, further comprising:

a plurality of flaps each pliably secured to the perimeter of the blanket and extending outwardly therefrom for folding over the blanket when in its closed position to secure the blanket in its folded position; and interconnecting means between the flaps for maintaining the flaps in their secured postion.

7. The fire pouch as defined in claim 6, wherein each of the flaps is formed from another granular hydrated intumescent material layer contiguous with the hydrated intumescent material layer which forms the blanket.

8. The fire pouch as defined in claim 1, wherein the pliable blanket is configured to unfold to a generally planar thin blanket having a width and height which define a generally rectangular configuration.

9. The fire pouch as defined in claim 1, wherein the gelled water material comprises water and sodium silicate.

10. The fire pouch as defined in claim 1, wherein the exterior container is fabricated from reticulated urethane.

11. A fire pouch for protecting flammable documents from fire and/or water damage, comprising:

a thin pliable fluid-tight exterior container having an interior defined by an outer skin layer and an inner skin layer spaced from the outer skin layer;

a gelled water material substantially filling the interior of the exterior container for absorbing thermal energy during a fire;

a pliable hydrated intumescent material layer secured to the inner skin layer opposite the gelled outer layer to absorb thermal energy and intumesce during a fire to produce a foam layer substantially thicker than the pliable hydrated intumescent material layer; and the exterior container and the hydrated intumescent material layer forming a relatively thin, pliable rectangular-shaped blanket having a seam which divides the blanket into a base position and a similarly-shaped cover position, such that the blanket unfolds by bending substantially along the seam to receive the flammable documents, and folds substantially along the seam such that the documents are sandwiched between the base portion and the cover portion to substantially enclose and protect the flammable documents during a fire.

12. The fire pouch as defined in claim 11, wherein the pliable blanket is configured to unfold to a generally rectangular-shaped blanket having a similarly-shaped base portion and cover portion.

13. The fire pouch as defined in claim 11, wherein the perimeter of the fluid-tight exterior container is sealed to hydrated intumescent material layer to seal the gelled water material within the exterior container.

14. The fire pouch as defined in claim 13, further comprising:

thread-like stitching about the perimeter of the exterior container for simultaneously sealing the outer skin layer to the inner skin layer while sewing the exterior container to the hydrated intumescent material layer.

15. The fire pouch as defined in claim 13, further comprising:

a plurality of flaps each pliably secured to the perimeter of the blanket and extending outwardly therefrom for folding over the blanket when in its closed position to secure the blanket in its folded position; and selectively engagable interconnecting means between the flaps maintaining the flaps in their secured position.

16. The fire pouch as defined in claim 15, wherein each of the flaps is formed from another granular hydrate gel layer contiguous with the granular hydrated intumescent material layer which forms the blanket.

17. A fire pouch for protecting flammable documents from fire and/or water damage, comprising:

a thin pliable fluid-tight exterior container having an interior defined by an outer skin layer and an inner skin layer spaced from the outer skin layer;

a gelled water material substantially filling the interior of the exterior container for absorbing thermal energy during a fire;

a pliable granular hydrated intumescent material layer secured to the inner skin layer opposite the gelled water layer to absorb thermal energy and intumesce during a fire to produce a foam layer substantially thicker than the pliable granular hydrated intumescent material layer: and the gelled water within the exterior container and the granular hydrated intumescent material layer forming a relatively thin, pliable blanket having a seam which divides the blanket into a base position and a similarly shaped cover position, such that the blanket unfolds by bending in substantially along the seam to receive the flammable documents and folds substantially along the seam such that the documents are sandwiched between the base portion and the cover portion to substantially enclose and protect the flammable documents during a fire;

the seam between the base portion and the cover portion being non-contiguous to allow gelled water communication past the seam and between the base portion and the cover portion; and an input port for inputting then sealing the gelled water into the interior of either the cover portion or the base portion for filling both the cover portion and the base portion with gelled water.

18. The fire pouch as defined in claim 17, wherein the granular hydrated intumescent material layer is selected from a group consisting of hydrates of silica, borax, and sodium.

19. The fire pouch as defined in claim 17, further comprising:

thread-like stitching about the perimeter of the exterior container for simultaneously sealing the outer skin layer to the inner skin layer and sewing the exterior container to the hydrated intumescent material layer.

20. The fire pouch as defined in claim 17, further comprising:

a plurality of flaps each pliably secured to the perimeter of the blanket and extending outwardly therefrom for folding over the blanket when in its closed position to secure the blanket in its folded position: and selectively engagable interconnecting means between the flaps for maintaining the flaps in their secured postion.

* * * * *